United States Patent [19]

Botker

[11] Patent Number: 4,903,282

[45] Date of Patent: Feb. 20, 1990

[54] ELECTRONIC COIN-COUNTING CONTROL

[75] Inventor: Kurt Botker, Thurmond, Md.

[73] Assignee: North American Philips Corporation, New York, N.Y.

[21] Appl. No.: 294,965

[22] Filed: Jan. 6, 1989

Related U.S. Application Data

[63] Continuation of Ser. No. 38,106, Apr. 14, 1987, abandoned.

[51] Int. Cl.[4] ..... G07F 17/20; G06M 3/10

[52] U.S. Cl. ..... 377/7; 377/2; 377/107; 307/542.1; 194/219

[58] Field of Search ..... 377/7, 107, 2; 307/542.1; 194/219, 220, 221

[56] References Cited

U.S. PATENT DOCUMENTS

| | | | |
|---|---|---|---|
| 3,333,111 | 7/1967 | Houle | 307/542.1 |
| 3,559,077 | 1/1971 | Porter | 307/542.1 |
| 4,015,142 | 3/1977 | Nagaoka et al. | 307/542.1 |
| 4,016,407 | 4/1977 | Mesecar et al. | 377/2 |
| 4,225,030 | 9/1980 | Kilman | 377/7 |
| 4,258,837 | 3/1981 | Manos et al. | 377/7 |
| 4,329,959 | 5/1982 | Javeri | 377/2 |

*Primary Examiner*—John S. Heyman

*Attorney, Agent, or Firm*—Thomas A. Briody; Jack E. Haken; Jack D. Slobod

[57] ABSTRACT

A device for counting events, such as deposit of coins, providing a control signal after an easily preset number of events has been counted. A binary counter has a parallel output register, with a simple switch and diode connected between each output terminal of the register and a common signal conductor. Individual switches are set to the binary number corresponding to the desired count, so that the voltage on the common conductor changes when the count equals or exceeds the binary preset number. When the circuit receives on electrical signal to be counted, a delay circuit prevents counting for some minimum interval of time, to prevent false counts due to switch bounce or other disturbances which may be related to the event. Energy is stored within the device to maintain the stored count for a short period of time in the event of power interruption between receipt of a first signal to be counted and provision of a control signal when the preset number of counts has been reached.

16 Claims, 2 Drawing Sheets

ELECTRONIC COIN-COUNTING CONTROL

This is a continuation of application Ser. No. 038,106, filed. Apr. 14, 1987, now abandoned.

BACKGROUND OF THE INVENTION

The invention relates to devices for indicating when a predetermined number of events have occurred, and automatically starting a new count of events only after the activity is completed. Such devices find special application, for example, in vending equipment for products or services such as washing or drying of clothing, which is rendered operable by deposit of a given number of coins which are counted by a coin accumulator. Desirably such a coin accumulator arrangement may be readily adjusted to provide a vending control signal only after deposit of an arbitrarily selected number of coins, where the number is easily adjusted by a maintenance procedure, and is limited only by the capacity of the accumulator.

Adjustable mechanical devices for counting coins have been made, but require the changing of cams, gears, or levers to program a number of coins required for operation. This reprogramming or adjustment is a relatively difficult task; and to minimize complexity and cost, these devices have a counting capacity which is limited to a very small number of coins.

One common difficulty with coin counting mechanisms is that the coin detection device, especially when it is a mechanical switch, is affected by mechanical shock. This problem may arise if a user of the equipment provides a sharp blow to the area around the coin slot, hoping to cause a sticking coin to drop. A variation of this problem commonly encountered is that the deposit of a single coin provides multiple signals because of contact bounce. This variation is also more of a problem if the equipment is struck while a coin is passing through the mechanism.

It is of course desirable that the counting mechanism start from zero when power is first applied to the equipment. A further problem arises when there is a power interruption during the course of counting coins. Mechanical and electro-mechanical systems, as used to date, are generally designed to reset to zero at the time of power interruption. The count of coins already deposited by a customer is then lost. This source of customer dissatisfaction has not previously been adequately corrected.

SUMMARY OF THE INVENTION

The object of the invention is to provide a versatile event-counting device which provides a signal at an easily-set number, and which ignores falsely-separated event signals.

A further object of the invention is to provide a coin counter for a vending mechanism, which can easily be adjusted to require a different number of coins in order to initiate vending.

An additional object of the invention is to enable coin counting to disregard false multiple signals, for example due to contact bounce or jarring of the machine, while a coin is passing the coin sensing device.

Yet another object of the invention is to provide an electronic coin accumulator having the ability to maintain the coin count despite power interruptions, while automatically resetting the counter to zero on completion of one cycle of vending operation.

In accordance with the invention, an electronic event accumulator includes an element which provides an electric signal in response to occurrence of an event; a resettable parallel output binary counter for receiving and counting those signals; a comparator, having a plurality of manually settable on-off switches corresponding to the respective digits of the binary count, for comparing the counter register output with a preset number, and providing a control signal when said register output has a value at least equal to said present number; a resetting arrangement for the counter register, which will set its output to zero only after a control signal has been sent which will enable the activity being controlled; and a disabling circuit which prevents counting of a next electrical signal occurring less than a certain period of time after the previous signal. Such an arrangement cannot produce a false count if, immediately prior to or just after occurrence of a valid event signal, one or more extra electric signals are received.

In the preferred embodiment of a coin accumulator according to the invention, the element is a switch or other sensor which provides an electric signal upon deposit of a coin. In general, this sensor is part of a chute arrangement which rejects slugs or coins of a different value. When the preset number of coins has been counted, the control signal enables vending operation (e.g., turn-on of a washer or dryer). The resetting arrangement does not enable the counter to count additional coins until the operation (e.g., washing cycles or drying cycle) is completed.

A preferred disabling circuit provides a delay time, during which the sensor signal must be continuous, before a count pulse is sent to the counter. This prevents a false count if the sensor generates one or more extra short signals.

Preferably, the comparator utilizes a respective diode in series with each manually settable switch, the switch and diode being connected in series between a single control signal conductor, and a respective terminal of the register output; and upon production of a control signal, a latching relay is set and remains set for the duration of the vending operation. It is also desirable that there be a short time delay after the relay has been reset, before the counter is enabled to count. The circuit providing such a delay can also assure that upon initially energizing the apparatus and circuit, the counter is not enabled until other start voltage changes or pulses have died away.

In a simple, preferred embodiment the coin detector is a normally closed switch, whose contacts are opened while a coin is passing by. A resistor-capacitor time-delay disabling circuit is connected to the switch, arranged such that the capacitor charges while the switch contacts are opened, and is immediately discharged by closing of the contacts.

DESCRIPTION OF THE PREFERRED EMBODIMENT

Figure 1:
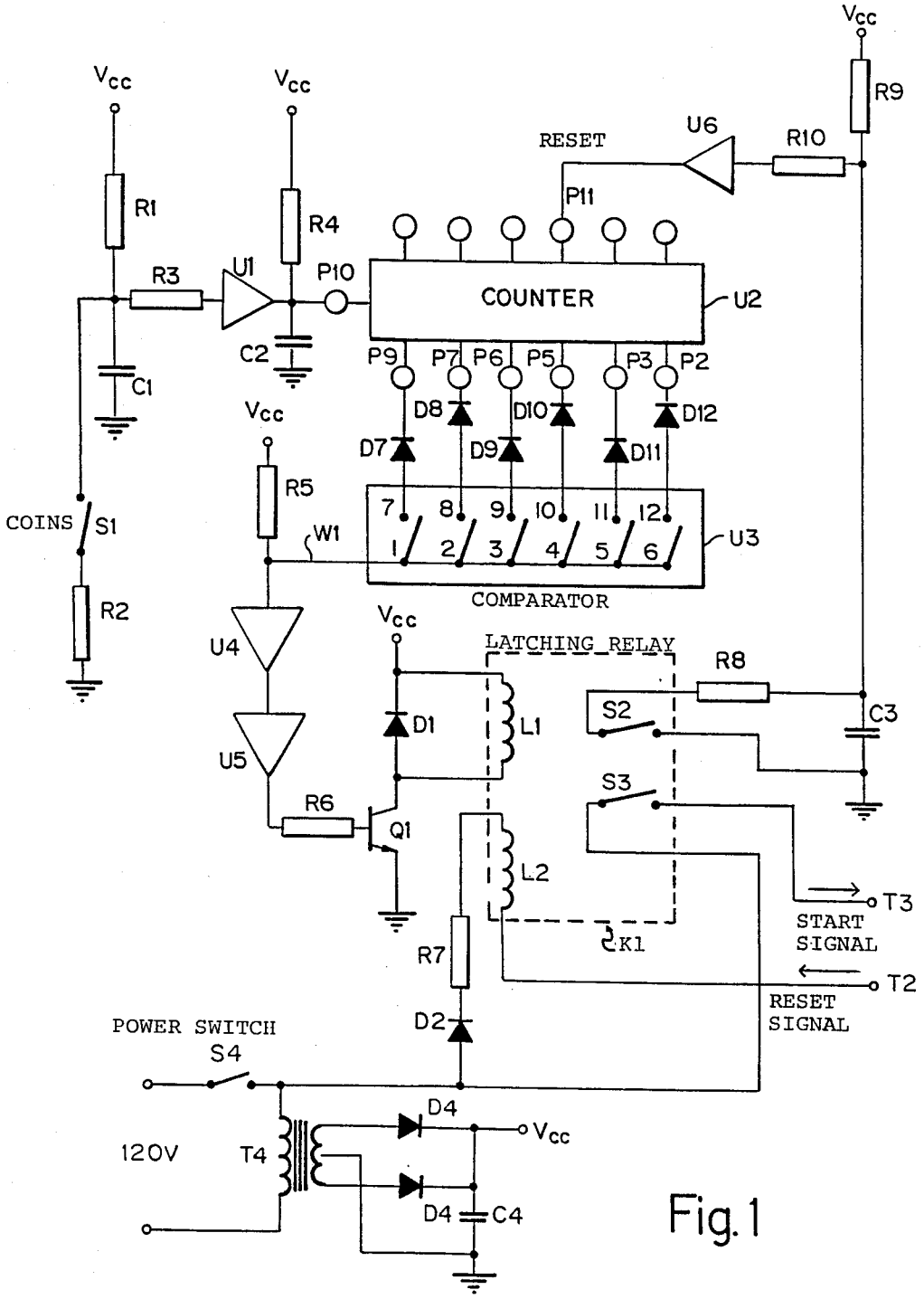
FIG. 1 is an electrical schematic diagram of an electronic coin accumulator for a clothes washer or dryer in accordance with the invention.

The circuit shown in FIG. 1 provides a count of electric signals generated by a switch 1 which preferably is of the type which is opened when a coin rolls past a switch finger. The finger is moved either by the weight of the coin or by deflection caused by sensing the diameter or thickness of the passing coin. The switch 1 is connected in parallel with a capacitor C1, for example having a value of 0.1 μf. Upon opening of the switch 1, the capacitor Cl commences to charge through a delay resistor R1, for example having a value of 220KΩ from a supply voltage $V_{cc}$. The R1-C1 circuit thus has a 22 millisecond time constant. This is long enough to discriminate against contact bounce occurring naturally within the switch S1, or resulting from a sharp blow made to the vending apparatus, not shown, in the vicinity of the coin slot. Upon reclosing of the switch, capacitor C1 is discharged almost instantaneously through a resistor R2, having a low value such as 470Ω.

The signal appearing on the R1-C1 network is applied to a first inverting trigger U1 through an isolating resistor R3 having a value of 220KΩ. Trigger U1 and the other triggers described below are conveniently provided in one package, such as type MM74C14N made by National Semiconductor Corp.

Unless Cl has been charging for a predetermined period of time, for example 20 milliseconds, the voltage will not rise sufficiently to trigger U1. The output of trigger 1 is provided to the input of a negative-going pulse counter U2 which is, for example, a type CD4040AE made by RCA. Thus, when the switch S1 has been open long enough during passage of a coin, the output of U1 falls and discharges a 0.001 μf noise-suppressing counting capacitor C2 below the triggering voltage of the counter U2. Between counts, when the switch S1 is closed, the output of trigger U1 goes high and capacitor C2 is charged through a 100kΩresistor R4, to be ready to receive a next count.

This first count causes the output terminal P9 of the register to rise from a binary zero to a binary one value. Successive counts produced by operation of the coin operated switch will cause the binary number to rise accordingly, and be displayed at the output register terminals P9, P7, P6, P5, P3 and P2 of the counter U2.

For setting a binary number corresponding to the number of coins which must be deposited to cause vending to commence, an adjustable comparator is formed by an array U3 of switches having respective terminals 1–6 connected to a signal conductor W1, and terminals 7–12 connected through respective diodes D7–D12 to the output terminals 2, 3, 5, 6, 7 and 9 respectively of the register. The operation of this comparator will be described below.

The signal conductor W1 is connected through a 47KΩ dropping resistor R5 to the source $V_{cc}$, and to the input of a second inverting trigger U4 whose output is connected to an inverting trigger U5, whose output in turn is connected through a 1OKΩ resistor R6 to the base of transistor Q1. Q1 may, for example, be a type 2-N5306 transistor, whose emitter is grounded, and whose collector is connected to the supply source $V_{cc}$ through the coil L1 of a latching relay K1 which is part of the resetting arrangement. A 1N914 diode D1 is connected around the coil L1 of the relay K1, to prevent inductive spikes from damaging the transistor when it is turned off sharply.

Reset coil L2 of the relay K1 is connected to the vending apparatus through a terminal T2, and is energized by grounding by an apparatus part, such as a timing and control switch at a point in the operation cycle when it is desired to enable the counting of additional coins for the initiation of a new cycle of coin collecting and vending. This grounding applies power to the reset coil L2 through a dropping resistor R7 and a diode D2. Depending on the current requirements of the reset coil, these may for example be a 1N4004 diode and a 4,000Ω, 5 watt resistor.

To effect resetting of the counter U2, a normally opened contact set S2 of the relay K1 is connected in parallel with a noise suppressing 1 μf capacitor C3. As explained subsequently, capacitor C3 also provides a desired turn-on delay. A 220Ω resistor R8 is connected in series with the switch S2 to limit the peak discharge current on the capacitor when the switch S2 is closed.

To provide a high level or positive reset signal to the counter U2, one side of the capacitor C3 is grounded, and the other side is connected to the supply source $V_{cc}$ through a resistor R9 having a value, for example, of 100Kμ and, through an isolating resistor R10 to inverting trigger U6. Isolating resistor R10 has a value, for example, of 220KΩ. The output of trigger U6 is connected to the reset terminal P11 of the counter U2.

To control an apparatus function, such as the initiation of operation of a washer or a dryer, a normally opened switch S3 which is part of the relay K1 is connected between a terminal T3 and an internal power or safety switch S4 through which a 120 volt power line supply is available.

Power for the circuit is obtained from a power transformer T4 also connected to the 120 volt supply line through the internal switch S4. The low voltage secondary winding of transformer T4 is preferably connected through a pair of diodes D4 such as type lN404, forming a full wave rectifier circuit connected to a smoothing capacitor C4 whose other terminal is, typically, connected to the secondary coil center tap and to the circuit ground point. The supply source $V_{cc}$ may be connected directly to the smoothing capacitor C4 or may be further filtered.

Except when one of the relay coils is energized, the circuit shown draws very little power. For example, between counts neither R4 or R9 carries current. This is especially true if the integrated circuits such as the counter U2 and the trigger package are types having low current drain when not changing state. As a result, a convenient size filter capacitor C4, such as 470 μf, stores sufficient energy to prevent loss of the stored count if a power outage lasting as long as 15 to 20 seconds is experienced.

Thus the inventive circuit overcomes a problem in the prior devices that, if there is a brief power failure between deposit of a first coin and deposit of the last one sufficient to initiate vending, these devices would reset to zero so the deposited coins were "lost."

Operation

When power is first applied to the circuit, for example by closing switch S4, the voltage across capacitor C4 will rise rapidly. Because the counter circuits are fully discharged, no count is stored in the counter, and the counter will present a relatively low impedance to ground through each of the six output terminals P2, P3, P5, P6, P7 and P9. At least one of the switches in the array U3 will have been closed in accordance with the binary number for the number of coins which will initiate vending, so that the signal conductor W1 will remain substantially at ground potential. The characteristics of the inverting triggers U4 and U5 will have been chosen such that the output of U5 remains near ground potential, transistor Q1 remains cut off, and no current flows through the coil L1 of the latching relay K1. Thus the relay contacts S2 and S3 remain open. The capacitor C2 ensures that there is no momentary initial pulse received on the counting input terminal of the counter U2. Because of the capacitor C3 in the input circuit to the trigger U6, the voltage on the input to inverting trigger U6 rises slowly, with a time constant of 0.1 second for the circuit values described. Thus for approximately 0.1 seconds the trigger U6 output remains high, and the counter U2 remains in the reset mode. As a result the entire circuit is protected from responding falsely to any electrical noise bursts associated with turning power on for the circuit and vending apparatus.

As coins are deposited, S1 is opened once for each coin. In the event of a user attempting to cause a counting pulse by striking the machine, the 22 millisecond time constant prevents contact bounce from providing a false signal sufficient to trigger U1. Each time the switch contacts close long enough to discharge Cl through R2, this R2-Cl circuit having a 47$\mu$ sec time constant, another approximately 20–25 millisecond time is required to allow the Cl voltage to rise enough to trigger U1.

Each triggering and subsequent re-setting of U1 provides a count signal, causing the respective output terminals of the counter U2 to go high or to zero, expressing in a binary fashion the total number of coins deposited. Switches of the array U3 will have been closed corresponding to the ones of the binary number expressing the total coin count which is to cause vending to commence. Thus a zero or low impedance appearing at any one of the counter output terminals whose switch is closed causes the signal conductor W1 to remain near ground potential. When each of those selected output terminals shows a 1, that is, the terminal goes high, then the conductor W1 rises to a voltage above the triggering voltage of the inverting trigger U4. This causes U4 to trigger, so that the output of U4 goes low, causing the output of inverting trigger U5 to go high and to turn on the transistor Q1. This operates the latching relay K1, so that the switches S2 and S3 each close. The voltage applied to terminal T3 upon closing of S3 causes some function in the apparatus to initiate vending, for example by turning on a clothes dryer and starting a timer.

Closing of switch S2 causes C3 to discharge through R8, resetting trigger U6 so its output goes high and immediately resets counter U2. Noise pulses generated in the vending apparatus cannot be counted in counter U2 so long as S2 remains closed.

Resetting the counter U2 output to zero's causes W1 to go low, resetting trigger U4 and triggering U5, so transistor Q1 is cut off and the current through set coil L1 of relay K1 falls to zero via the inductive-pulse-preventing diode D1.

When the vending cycle is completed, as described above a switch elsewhere in the apparatus will connect the terminal T2 to the low side of the 120 volt line, powering the reset coil L2 of the latching relay and releasing the relay. Opening of switch S2 permits the voltage to rise across capacitor C3, causing inverting trigger U6 to trigger after about 0.1 seconds so that reset terminal P11 of the counter U2 goes low. This enables the counter to resume counting if coins are inserted.

Other Embodiments

Those of ordinary skill in the art recognize that there are many alternatives to various portions of the circuit shown, which will provide an accumulator or counting device falling within the spirit and scope of the invention. Many sensing devices, other than a switch S1, may be used to sense events to be counted. Thus a coin counting control may use an optical, magnetic, or electric sensing which may be particularly adapted to distinguish between a proper coin and a slug or coin of a lesser denomination.

Figure 2:
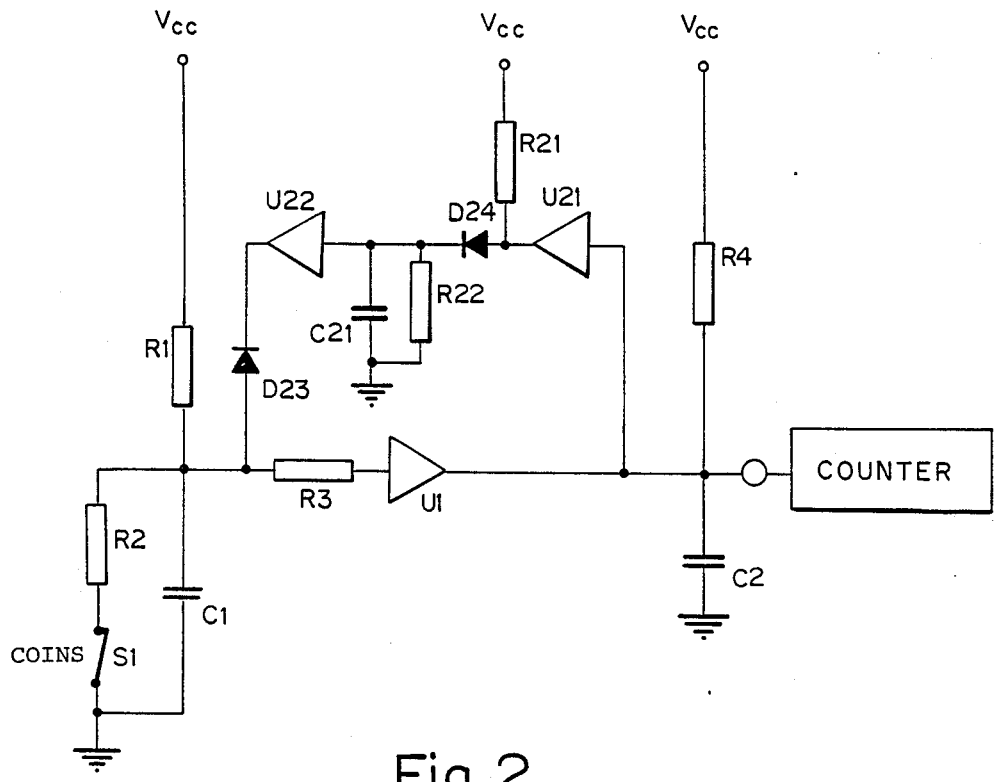
FIG. 2 is a similar diagram of a portion of a circuit with a different form of delay.

The disabling circuit may, in addition to or instead of providing a delay time during which an indicating signal must be continuous, operate to inhibit any effect occurring for a period of time after counting of a signal. For example, a delay circuit may be inserted to delay resetting of trigger U1 after it has triggered, or a delayed clamping circuit may prevent the input to trigger U1 from again rising for a predetermined period of time after U1 has triggered.

Where the event to be counted has a relatively short duration in comparison with the switch closure in a simple coin slot, the desired amount of delay may exceed the duration of the electrical signal which, in the embodiment of FIG. 1, charges the capacitor Cl. In that event an alternative circuit shown as that such in FIG. 2 may be preferable. Cl may have a far smaller value, or may be omitted entirely. Alternatively, the nature of the event may be one which inherently is apt to produce a plurality of input pulses or sensing signals somewhat spaced in time, so that it is desirable that the incoming circuit does not integrate any further signals received from the sensor for a predetermined interval after a pulse has been counted. The circuit shown in FIG. 2 provides both an integrating delay before a pulse is counted, and then a delay interval during which incoming signals are completely suppressed. This circuit may be identical to that of FIG. 1, except for the addition of two diodes, two triggers, one capacitor, and two resistors.

The circuit of FIG. 2 operates identically to that shown in FIG. 1, up to the instant that an incoming signal is counted. Parts with like numerals are identical to the corresponding parts shown in FIG. 1. The effect of the added parts is to cause the trigger U1 to be reset shortly after a pulse has been counted, and to prevent charging of the capacitor Cl for a predetermined period of time after that resetting, regardless of whether switch S1 is open or closed.

The additional elements required to provide the fixed interval of inhibition for incoming signals include a trigger U21 whose input is connected to the output of trigger U1, a trigger U22 whose input is connected to the output of trigger U21 through a diode D24, and whose output is connected to the input circuit of trigger U1 through the diode D23. The diodes D23 and D24 are each poled so that their cathodes are connected to the trigger U22. In the circuit shown, D23 connects to the capacitor Cl; but if Cl is omitted, or a different connection is desired for other reasons, diode D23 may be connected directly to the input of trigger U1.

The output of trigger U21 is connected to the supply voltage $V_{cc}$ through resistor R21 which forms part of a pulse stretching network. A capacitor C21 and resistor R22 are connected in parallel between the input of trigger U22 and ground, to provide the desired interval delay.

The added circuit elements operate as follows: when the total circuit is ready to accept a signal from the switch S1, the output of trigger U1 is high so that the trigger U21 is set, or triggered. The output of U21 is therefore low, and capacitor C21 is discharged almost completely through resistor R22, except for any residual voltage coupled from the low output of U21 through the diode D24. Trigger U22 is therefore reset, so that in this mode of operation the trigger U22 is affectively isolated from the input of trigger U1 by the diode D23.

When switch S1 has been opened long enough so that trigger U1 triggers, trigger U21 is reset at the same time that a negative pulse is counted by the counter. Capacitor C21 at the input to trigger U22 is now charged through the resistor R21 and diode D24. The resistor R22 will normally have a value many times higher than R21, so that U22 is triggered after a pulse-stretching delay established by the R21-C21 time constant. This time constant might, for example, be as long as one millisecond and need be long enough only to guarantee that the counter receives a sufficiently long negative pulse to provide an effective count. When U22 triggers, U1 is reset by the discharging of capacitor Cl through diode D23. U21 is immediately triggered, but because of the coupling diode D24 this has no effect on the interval timing circuit R22-C21. This interval timing circuit may have its values selected to provide a relatively long time constant, measured in milliseconds or even in seconds or minutes, depending on the nature of the device and the events to be counted. When the voltage across C21 has dropped to the point where U22 resets, the device input circuit then becomes enabled to accept a new signal from the switch S1 or other input sensor.

To allow a longer time for charging of capacitor C21, a time delay may be incorporated between the output of U1 and the input of U21.

The extreme simplicity of each embodiment of the disclosed counting device, and the ability readily to provide one which counts to a high total count, may be used to count other kinds of events which are desired to control some activity. For example, the number of times or cycles that an apparatus performs a certain function can be counted by sensing an electric or other signal related to that function, so that a maintenance or renewal procedure takes place at the end of a readily preset number of such cycles.

When such cycles, to be counted, may be spaced far apart in time, even over many days, the ability of the counter to maintain the stored count despite power line outages becomes an important feature. In this respect, a circuit variation in which a battery provides keep-alive power only to the counter and to R9 and C3 is especially valuable, because then a very tiny battery can provide sufficient power for many days or even months.

The use of an electro-mechanical latching relay is very convenient when a plurality of apparatus functions are to be enabled, and these are preferably powered by 120 volt AC actuators or motors. Where low power, low voltage control signals from the counting device suffice, those of ordinary skill in the art can readily substitute an electrical latching circuit, or a circuit which will disable further counting and cause the counter to reset after a fixed, predetermined period of time.

Finally, other circuits or sources of keep-alive energy to the counter, other than the power supply filter or a simple battery and diode connection, may be preferable in particular applications. For example, it may be desired that the counter will automatically be reset to zero, if power is interrupted for more than a certain number of seconds or minutes. In that circumstance keep-alive power may be applied through a timing circuit. Thus the scope of the invention is to be measured solely by the appended claims.

I claim:

1. A device for determining occurrence of a selected number of events spaced in time by a minimum interval, comprising means for providing an input electric signal in response to occurrence of an event, a resettable counter having a plurality of output terminals providing a parallel binary coded register output for counting said electric signals, means for comparing said output with a pre-set number to provide a control signal when said output at least equals said number, comprising a conductor, a plurality of manually settable switches corresponding to the respective digits of the binary coded output, and a plurality of diodes corresponding to said plurality of switches, each respective switch and a respective diode being connected in series between said conductor and a respective terminal of the register parallel output, means for resetting said register output to zero after provision of said control signal, comprising latching relay means which is latched by a set coil in response to said one control signal, and which is unlatched only upon occurrence of a predetermined condition; and while latched disables the counter from counting, said means for resetting further comprising a delay circuit arranged such that said counter is enabled only after a predetermined period of time after said latching relay means is unlatched, and means, responsive to said input electric signal, for preventing counting for said minimum interval, whereby false signals do not generate a false count.

2. A device as claimed in claim 1, characterized in that said means for preventing comprises a first delay circuit, and the delay circuit forming part of said means for resetting is a second delay circuit.

3. A device as claimed in claim 2, characterized in that said second delay circuit further is arranged to provide a delay, following initial turn-on of an apparatus in which the device is incorporated, to prevent a false count due to apparatus switching noise for a difference in time required for each of the portions of the device to reach their normal voltage level.

4. A device as claimed in claim 3, comprising means for supplying electrical energy to said counter sufficient to maintain a binary count in the register output upon interruption of a supply of power to the device for at least a predetermined period of time.

5. A device as claimed in claim 1, comprising an energy storage capacitor for supplying electrical energy to said counter sufficient to maintain a binary count in the register output upon interruption of a supply of power to the device for a period of at least 15 seconds.

6. An electronic coil accumulator, comprising means for providing an input electric signal in response to deposit of a coin, a resettable counter having a plurality of output terminals providing a parallel binary coded register output for counting said electric signals, means for comparing said output with a pre-set number to provide a control signal when said output at least equals said number, comprising a conductor, a plurality of manually settable switches corresponding to the respective digits of the binary coded output, and a plurality of diodes corresponding to said plurality of switches, each respective switch and a respective diode being connected in series between said conductor and a respective terminal of the register parallel output, means for resetting said register output to zero after provision of said control signal, said means comprising a latching relay having a set coil for operating and latching the relay, and a relay contact which provides a resetting signal for said register, arranged such that said counter is enabled to count only after said relay is unlatched, means, responsive to said electric signal, for preventing counting for a predetermined period of time, whereby rapidly repeated electric signals do not generate a false count, and an energy storage capacitor for supplying electrical energy to said counter sufficient to maintain a binary count in the register output upon interruption of a supply of power to the device for a period of at least 15 seconds.

7. A coin accumulator as claimed in claim 6, characterized in that said means for resetting includes a delay circuit arranged such that said register output is reset to zero only after a predetermined period of time after said relay is reset.

8. An electronic coin accumulator, comprising a mechanically operated electric switch having open and closed conditions, arranged to switch from one of said conditions to the other condition upon deposit of a coin, said switching having a normally closed pair of contacts connected to said register so as to provide a "zero " signal while said contacts are closed, said contacts being opened in response to deposit of a coin, said switch further comprising an electric circuit for providing an electric signal in response to switching to said other condition, a resettable register having a parallel binary coded output for counting said electric signals, means for comparing said output with a pre-set number to provide a control signal when said output at least equals said number, comprising a conductor, a plurality of manually settable switches corresponding to the respective digits of the binary coded output, and a plurality of diodes corresponding to said plurality of switches, each respective switch and a respective diode being connected in series between said conductor and a respective terminal of the register parallel output, means for resetting said register output to zero after provision of said control signals, comprising a latching relay having a set coil for operating and latching the relay, and a relay contact which provides a signal for said register, arranged such that said register does not count any electric signals provided while said relay is latched, a time delay circuit connected to said switch, arranged to inhibit provision of an electric signal to said register for a predetermined period of time after switching to said other condition, resulting from contact bounce of said switch a resistor and a capacitor arranged such that, upon opening of said switch contacts, said capacitor is charged via said resistor; and upon momentary closing of said switch, said capacitor is discharged; said time delay circuit having a time constant selected such that said electric signal rises sufficiently rapidly to be counted by said register in a period of time substantially less than the period for which said contacts are closed during normal deposit of a coin, and an energy storage capacitor for supplying electrical energy to said counter sufficient to maintain a binary count in the register output upon interruption of a supply of power to the device for a period of at least 15 seconds.

9. A coin accumulator as claimed in claim 8, characterized in that said means for resetting includes a second delay circuit arranged such that said counter is enabled to count said electric signals only after a predetermined period of time after said relay is reset.

10. An accumulator as claimed in claim 9, characterized in that said second delay circuit further is arranged to provide a delay, following initial turn-on of an apparatus in which the accumulator is incorporated, to prevent a false count due to switching noise for a difference in time required for each of the portions of the circuit to reach their normal voltage level.

11. A coin accumulator as claimed in claim 8, characterized in that said means for resetting includes a second delay circuit arranged such that said counter is enabled to count said electric signals only after a predetermined period of time after said relay is reset.

12. A device for determining occurrence of a selected number of events spaced in time by a minimum interval comprising:

means for providing an electric event signal in response to the occurrence of an event, a counter having a counting signal input, a reset input and a plurality of output terminals providing a parallel binary coded register output representing a count of the number of counting signals input to said counter;

means for comparing said register output with a preset number to provide a control signal when said register output at least equals said number, comprising a plurality of manually settable switches corresponding to the respective digits of the binary coded output, a conductor, and a plurality of diodes corresponding to said plurality of switches, each respective switch and a respective diode being connected in series between said conductor and a respective terminal of the register parallel output, means for resetting said register output to zero after provision of said control signal, said means including latching means which is set upon provision of said one control signal and which is unlatched only upon occurrence of a predetermined condition, and while latched, said latching means disables the counter from counting, and a delay circuit responsive to an output of said latching means and feeding the reset input of said counter such that said counter is enabled only after a predetermined period of time after said latching means is unlatched and, means responsive to said event signal for providing counting signals to said counter in response to those of said event signals which are spaced in time at least said minimum interval whereby false event signals do not generate a false count.

13. A device as claimed in claim 12, characterized in that said means for providing counting signals comprises a first delay circuit, and in that the delay circuit forming part of said means for resetting the counter is a second delay circuit.

14. A device as claimed in claim 13, characterized in that said second delay circuit further is arranged to provide a delay, following initial turn-on of an apparatus in which the device is incorporated, to prevent a false count due to apparatus switching noise for a difference in time required for each of the portions of the device to reach their normal voltage level.

15. A device as claimed in claim 14, comprising means for supplying electrical energy to said counter sufficient to maintain a binary count in the register output upon interruption of said power supply for at least a predetermined period of time.

16. A device as claimed in claim 15 wherein said predetermined period of time is 15 seconds.

* * * * *